United States Patent [19]

Faris et al.

[11] 4,191,954

[45] Mar. 4, 1980

[54] INTERRUPTED CIRCUIT TEST WITH MEMORY AND DISPLAY DEVICE

[75] Inventors: Charles G. Faris; Edward H. Manley, both of Sedalia, Mo.

[73] Assignee: Swiss Aluminium Ltd., Chippis, Switzerland

[21] Appl. No.: 921,817

[22] Filed: Jul. 3, 1978

[51] Int. Cl.[2] ..... G08B 23/00

[52] U.S. Cl. ..... 340/679; 307/116; 340/502; 340/517

[58] Field of Search ..... 340/517, 502, 520, 679, 340/680; 307/113, 116; 74/2

[56] References Cited

U.S. PATENT DOCUMENTS

| | | | |
|---|---|---|---|
| 3,184,725 | 5/1965 | Siegel et al. | 340/679 X |
| 3,286,246 | 11/1966 | Vosper | 340/502 |
| 3,500,394 | 3/1970 | Egesdal | 340/517 X |
| 3,550,121 | 12/1970 | Porter, Jr. | 340/502 |
| 3,636,375 | 1/1972 | Armstrong | 340/679 X |
| 3,656,139 | 4/1972 | Wintriss | 340/680 X |
| 3,729,734 | 4/1973 | Kipling | 340/679 X |
| 3,991,413 | 11/1976 | Berger | 340/679 X |

*Primary Examiner*—John W. Caldwell, Sr.
*Assistant Examiner*—Joseph E. Nowicki
*Attorney, Agent, or Firm*—Bachman and LaPointe

[57] ABSTRACT

An improvement in fault detection and stop motion systems in which an electronic circuit is capable of sensing and displaying any one of a number of malfunctions on each of a plurality of parallel operating members on a machine and interrupting operation thereof upon detection of any such malfunction.

8 Claims, 1 Drawing Figure

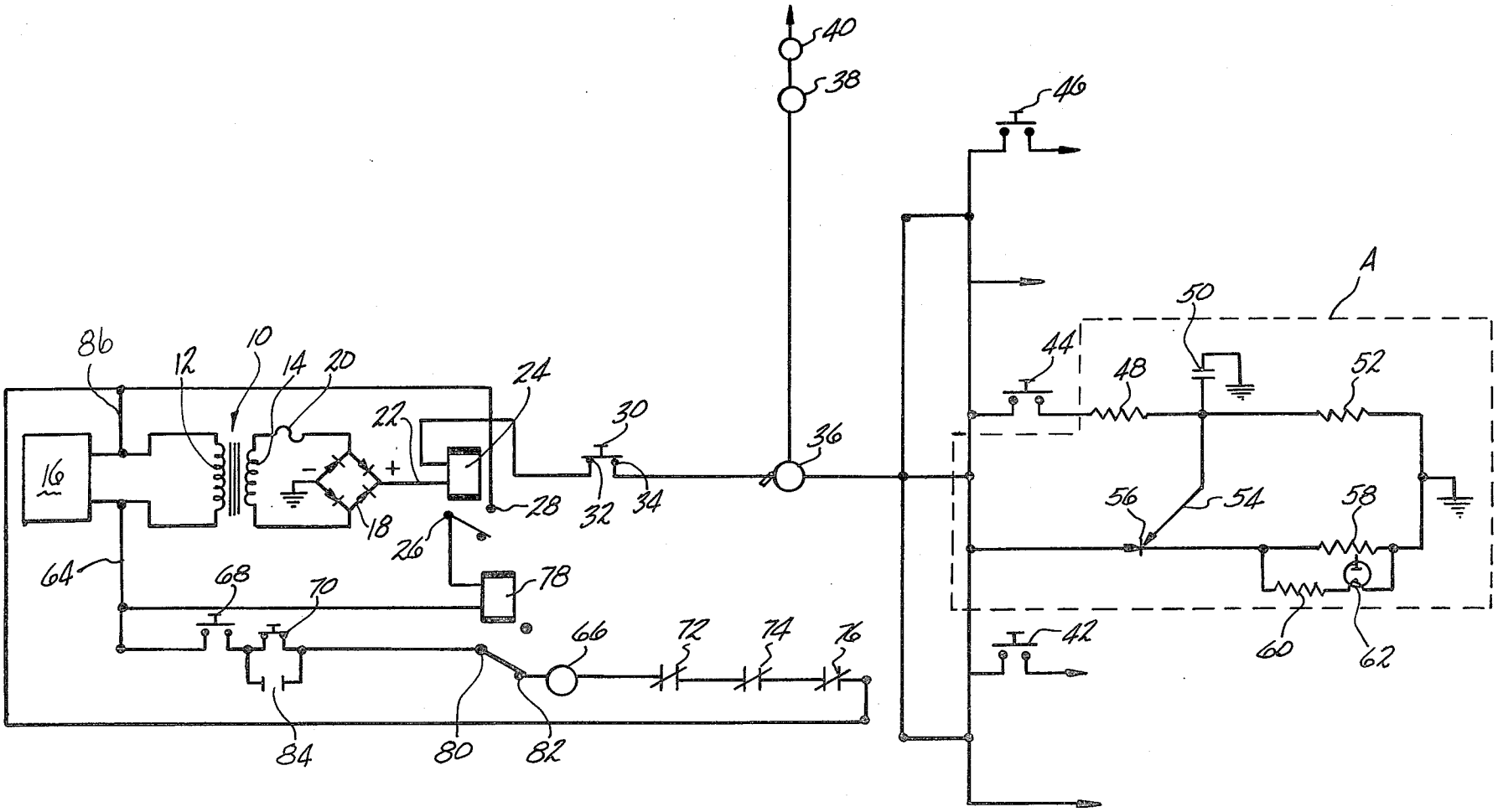
A
10
12
14
16
18
20
22
24
26
28
30
32
34
36
38
40
42
44
46
48
50
52
54
56
58
60
62
64
66
68
70
72
74
76
78
80
82
84
86

INTERRUPTED CIRCUIT TEST WITH MEMORY AND DISPLAY DEVICE

BACKGROUND OF THE INVENTION

The present invention is drawn to a fault detection and stop motion system and more particularly to an electronic circuit which is capable of sensing and displaying any one of a number of malfunctions on each of a plurality of parallel operating members. The electronic circuit of the present invention is particularly useful for detecting malfunctions in and cutting out the drive to wire stranding machines.

Known apparatuses for detecting and displaying malfunctions on machines such as textile machines and wire stranders where a plurality of parallel operating members are employed have, in recent years, become more and more complicated due to the necessity of providing a system which not only senses a malfunction and upon sensing shuts down operation of the machine but also indicates which operating member malfunctions and what the malfunction is. These complications consequently lead to added costs in material and labor in order to provide a detecting apparatus which fulfills the needs of manufacturers.

In addition to the above-noted disadvantages, prior art systems such as that disclosed in U.S. Pat. No. 3,321,755 suffers from the additional disadvantage of being slow to operate thus increasing the likelihood of injury to the operator and damage to both the product being manufactured as well as the machine itself.

Accordingly, it is the principal object of the present invention to provide an improved circuit for detecting malfunctions and shutting down the operation of a multi parallel operating member machine.

It is a primary object of the present invention to provide a fault detection, stop motion system which is capable of identifying where a malfunction has occurred.

It is a further object of the present invention to provide an electronic control system which is capable of identifying the cause of a malfunction.

It is a prinicpal object of the present invention to provide an electronic control system which continues to identify location and cause of malfunction even after the detection device is disengaged.

It is a still further object of the present invention to provide an electronic fault detection, stop motion system with a fast shutdown operation.

It is yet another object of the present invention to provide an electronic control system which is dependable in operation and economically efficient to make.

Other objects and advantages will be made apparent from a consideration of what appears hereinbelow.

SUMMARY OF THE INVENTION

In accordance with the present invention the foregoing objects and advantages are readily attained.

The present invention relates to an improved fault detection and stop motion system in which an electronic circuit is capable of sensing and displaying any one of a number of malfunctions on each of a plurality of parallel operating members on a machine and interrupting operation thereof upon detection of any such malfunction. The system of the present invention employs solid state components which are built into modules that are mounted on each of the operating members of the machine to detect malfunction. Each operating member is provided with a plurality of circuits for sensing different malfunctions of the member. Each module is provided with means to indicate whether it has been actuated. Upon sensing a malfunction, the indicating means is actuated and at the same time the drive motor is shut down.

BRIEF DESCRIPTION OF THE DRAWING

The present invention will be more readily understood from a consideration of the following illustrative drawing in which:

FIG. 1 is a schematic diagram of the control circuit of the present invention.

DETAILED DESCRIPTION

The control system of the present invention, for purposes of illustration only, is shown and disclosed as being used on a tubular wire strander machine. It should be appreciated, however, that the control system of the present invention may be employed on knitting machines, other textile machines or any other machine where a plurality of operating members are employed.

Referring to FIG. 1, transformer 10 is provided with input coil 12 and output coil 14. A high voltage alternating current supply 16 is connected to input coil 12 thereby supplying current to transformer 10. Output coil 14 is connected to full wave rectifier 18 via fuse 20 so as to supply low voltage direct current to the circuit via line 22. Line 22 is connected to a normally deenergized fault relay 24 which has normally open contacts 26 and 28. A normally closed reset button 30 is connected in series on one contact terminal 32 with fault relay 24 and on the other contact terminal 34 with fault memory modules located on each of the cradles 36, 38, 40, etc.

Each cradle is provided with a plurality of spring lever operated switches 42, 44 and 46 which serve as a cradle lock detector, cradle tilt left detector and cradle tilt right detector respectively. Connected with each of the detector switches is a fault memory module circuit A in accordance with the present invention. All of the fault memory modules are identical and therefore a description of one will suffice. Referring again to FIG. 1, located in series with switch 44 is resistor 48 which in turn is connected in series with capacitor 50 and resistor 52 which are grounded. Resistors 48 and 52 as well as capacitor 50 control and regulate the voltage to the gate 54 of silicon controlled rectifier 56 so as to limit the current to the gate and prevent operation of silicon controlled rectifier 56 from stray voltages. The resistor 52 discharges capacitor 50 of any excess voltage. Connected in series with silicon controlled rectifier 56 is resistor 58 which in turn is connected in parallel with resistor 60 which is in series with light emitting diode 62, the whole circuit being grounded. Resistor 60 limits current to light emitting diode 62 while resistor 58, in parallel with resistor 60, balances the resistance of fault relay 24 for correct voltage distribution.

Connected by line 64 with high voltage current supply 16 is motor 66 which is provided to operate the wire stranding machine for which the electronic control system of the present invention is particularly suitable for use on. Provided in line 64 in series with motor 66 is a normally closed conventional stop switch 68, overloads 72, 74 and 76 and start switch 70. Provided in parallel with normally opened start switch 70, as is well known, is sealed in contact 84. Connected in series with motor 66 and power supply 16 is relay 78 having normally closed contacts 80 and 82. Relay 78 is normally deenergized and is connected in series with normally opened contacts 26 and 28 of fault relay 24. One end of relay 78 is connected to line 64 the other end being connected to power supply 16 via line 86.

The improved circuit of the present invention comprises a fault memory module which may be readily mounted on the cradle of a wire strander or other machines such as knitting machines.

The operations of the control circuit of the present invention will be made clear when considering the following detailed description.

With the wire strander in normal operation, start switch 70, stop switch 68 and contacts 80 and 82 of relay 78 are closed thus allowing the motor 66 to be energized by power source 16 to drive the wire strander. Contacts 26 and 28 of normally deenergized fault relay 24 are open as are fault detector switches 42, 44 and 46. Reset button 30 is closed.

Assume a malfunction occurs in the wire strander causing cradle 36 to tilt left which is sensed by switch 44 which is closed completing the circuit. Closure of switch 44 causes DC current to flow through fault relay 24, resistor 48 to gate 54 of silicon controlled rectifier 56. This current "turns on" silicon controlled rectifier 56 such that it operates as a closed switch so as to allow current to flow from anode to cathode across resistor 58, resistor 60, light emitting diode 62 to ground thereby turning on diode 62. The current also energizes fault relay 24 which closes contacts 26 and 28 thereby energizing relay 78 which opens contacts 80 and 82 so as to stop motor 66. The operator examines the cradles, finds the tilt left light of cradle 36 lit and corrects the malfunction of the machine. It is a particular feature of the present invention to provide DC current passing through the silicon controlled rectifier 56 so that fault relay 24 and diode 62 remain energized even after switch 44 is opened. Reset button 30 when opened "turns off" silicon controlled rectifier 56 and deenergizes fault relay 24 opening contacts 26 and 28 which in turn deenergizes relay 78 thereby closing contacts 80 and 82. The machine is then ready to be restarted.

This invention provides an instantaneous stop motion, motor cut off system which detects and locates a machine malfunction and continues to operate even after the detector circuit is opened. The system is instantaneously responsive and highly reliable.

It is to be understood that the invention is not limited to the illustrations described and shown herein, which are deemed to be merely illustrative of the best modes of carrying out the invention, and which are susceptible of modification of form, size, arrangement of parts and details of the operation. The invention rather is intended to encompass all such modifications which are within its spirit and scope as defined by the claims.

What is claimed is:

1. A fault detection, indication and motor cut off system, the combination comprising:

at least one fault detection circuit, said at least one fault detection circuit comprises at least one fault memory circuit;

said at least one fault memory circuit comprises a first circuit path, said first circuit path including a detector switch means and a silicon controlled rectifier gate connected in series and a second circuit path in parallel with said first circuit path, said second circuit path including a silicon controlled rectifier and a light emitting source connected in series;

a source of DC voltage;

first control circuit path having two terminals for passing current through said path, one of said terminals being connected to said at least one fault detection circuit, the other of said terminals being connected to said source of DC voltage;

fault control relay means in said first control circuit path through which current passes upon activation of said detector switch means, said fault control relay means having normally opened contacts;

motor control circuit path connected at its ends to a source of alternating voltage;

relay means in said motor control circuit path through which current passes upon energizing of said fault control relay in said first controlled path by activation of said detector switch means, said relay means having normally closed contacts; and wherein DC voltage is supplied to said silicon controlled rectifier gate and said fault control relay upon activation of said detector switch so as to pass current through said silicon controlled rectifier thereby activating said light source.

2. The combination of claim 1 wherein said DC voltage passing through said fault control relay energizes said fault control relay to close its normally opened contacts whereby said relay in said motor control circuit is energized to open normally closed contacts thereby inactivating said motor control circuit.

3. The combination of claim 2 wherein said source of DC voltage include a source of alternating current connected in series with a transformer and a full wave rectifier.

4. The combination of claim 1 including a plurality of fault detector circuits connected in parallel, each of said fault detector circuits comprising a plurality of fault memory circuits connected in parallel.

5. The combination of claim 1 wherein said second circuit path includes first resistor means connected in series with said light emitting source and second resistor means connected in parallel with said first resistor means and light emitting diode.

6. The combination of claim 5 wherein said first circuit path includes a capcitor connected in series with said detector switch means so as to regulate and control voltage to said silicon controlled rectifier gate.

7. The combination of claim 1 wherein said current continues to pass through said silicon controlled rectifier after said detector switch is deactivated.

8. The combination of claim 7 including a normally closed reset button in said first control circuit path which, when opened, deenergizes said silicon controlled rectifier thereby inactivating said light source.

* * * * *